US005174088A

United States Patent [19]

Focke et al.

[11] Patent Number: 5,174,088

[45] Date of Patent: Dec. 29, 1992

[54] PROCESS AND APPARATUS FOR PRODUCING BAG-LIKE PACKS FOR IN PARTICULAR CHEWING TOBACCO SUBSTITUTE

[75] Inventors: Heinz Focke, Verden; Uwe Dreyer, Wuppertal, both of Fed. Rep. of Germany

[73] Assignee: Focke & Co., Verden, Fed. Rep. of Germany

[21] Appl. No.: 690,182

[22] Filed: Apr. 19, 1991

[30] Foreign Application Priority Data

Apr. 26, 1990 [DE] Fed. Rep. of Germany ..... 4013230

[51] Int. Cl.[5] ..... B65B 1/24; B65B 43/04; B65B 55/18; B65B 63/02

[52] U.S. Cl. ..... 53/431; 53/439; 53/455; 53/111 R; 53/529; 53/562

[58] Field of Search ..... 53/469, 455, 562, 439, 53/529, 252, 473, 479, 431, 530, 258, 438, 111

[56] References Cited

U.S. PATENT DOCUMENTS

| | | | |
|---|---|---|---|
| 2,092,763 | 9/1937 | Frank | 53/473 X |
| 2,272,251 | 2/1942 | Robinson | 53/455 |
| 2,330,361 | 9/1943 | Howard | 53/455 |
| 2,567,052 | 9/1951 | Carruthers | 53/438 X |
| 2,653,430 | 9/1953 | Vogt . | |
| 2,721,017 | 10/1955 | Hiscock | 53/455 X |
| 2,923,111 | 2/1960 | Selock | 53/562 X |
| 3,213,587 | 10/1965 | Carruthers | 53/473 X |
| 3,371,461 | 3/1968 | Aronson | 53/455 X |
| 3,486,290 | 12/1969 | Pretzer | 53/439 |
| 3,578,778 | 5/1971 | Matthews et al. . | |
| 3,631,903 | 1/1972 | Huggins | 53/562 X |
| 3,696,581 | 10/1972 | Eisenberg | 53/473 X |
| 3,866,394 | 2/1975 | Masai . | |
| 4,007,577 | 2/1977 | Matthews . | |
| 4,607,479 | 8/1986 | Linden . | |
| 4,703,765 | 11/1987 | Paules et al. . | |

FOREIGN PATENT DOCUMENTS 2405691 6/1978 Fed. Rep. of Germany .

*Primary Examiner*—Horace M. Culver
*Attorney, Agent, or Firm*—Sughrue, Mion, Zinn, Macpeak & Seas

[57] ABSTRACT

A process and apparatus for producing bag-like packs including a continuous strand (17) which is formed from packaging material folded in a V-shape and having transverse seams (15). Prepared portions (21) of fibrous filling material are pushed into pockets (18), open at the side, during the continuous transporting of the strand (17) by the apparatus. Thereafter, the pockets (18) are closed at a longitudinal seam (16) formed during the continuous transporting. The packs are formed by being severed from the strand (17). The strand (17) and the portions (21) are transported by synchronously running endless conveyors, and specifically by a spreading ring (27) and a portion turret (35), respectively. The above-mentioned conveyors are mounted axially parallel to each other such that, with synchronous running, the portions (21) are pushed radially out of the portion turret (35) into the pockets (18).

18 Claims, 9 Drawing Sheets

PROCESS AND APPARATUS FOR PRODUCING BAG-LIKE PACKS FOR IN PARTICULAR CHEWING TOBACCO SUBSTITUTE

BACKGROUND OF THE INVENTION

The invention relates to a process for producing bag-like packs from two pack walls, joined together all around the edges, for portions of fibrous filling material, in particular for chewing tobacco (substitute), a continuous strand of pockets, open at the side, being formed from a web of packaging material, into each of the pockets a portion of filing material is introduced, the pockets then being closed by a closure seam (longitudinal seam) and finally severed from the web by severing cuts in the region of transverse seams. Furthermore, the invention relates to an apparatus for producing such packs.

A process and apparatus of the abovementioned type are shown and described (FIG. 7) in U.S. Pat. No. 4,607,479. In the case of this known apparatus, the strand of pockets, open at the side, is taken tangentially past a filling wheel The portions formed in this filling wheel are blown into the pocket in the radial direction by blowing air via a relatively small spout (piece of pipe).

Due to the intermittent operation, the efficiency of this known apparatus is limited. Another disadvantage is the introduction of the portions by blowing air via a relatively small filling opening (spout). There is the risk that part of the portion to be introduced does not go into the pocket.

On this basis, the object of the invention is to improve the formation of portions, their introduction into the pockets and the finishing of the portions, in particular to the effect that an efficient, continuous mode of operation is possible.

SUMMARY OF THE INVENTION

To achieve this object, the process according to the invention consists in that the portions of the filling material are continuously transported synchronously with the assigned packs, are brought during transporting to a format corresponding to the pack volume, in particular are compressed, and then, during the continued transporting movement along a transporting path immediately adjacent to the transorting path of the packs, are pushed into the latter.

In the case of the invention, the portions are accordingly prepared in a continuous method of working and conveyance by mechanical members, namely by compressing to a size and shape suitable for packing, and then pushed into the open packs (pockets) during the continued transport, to be precise in particular by the member for compressing the portions. As a result, an efficient production, namely filling of the bags with fibrous material, is achieved.

The apparatus according to the invention for producing the packs consists of two endless conveyors, in particular two turrets or discs, revolving at the same circumferential speed, one of the turrets or discs having chambers for receiving the portions and the other having spreading members for holding open the pockets of the strand.

Particularly advantageous is an arrangement according to the invention in which the two circular endless conveyors (portion turret and spreading ring) with different outside dimensions are mounted axially parallel one in the other. The portion turret, designed with a smaller diameter, is surrounded by the outer spreading ring, the portion turret and spreading ring being arranged offset to each other. During the co-ordinated, synchronously running rotational movement of the portion turret on the one hand and the spreading ring on the other hand, on the latter the strand of pockets, open on one side, is formed, the pockets facing with a spread opening radially inwards The portion turret is provided with a number of receptacles (chambers) for one portion each. The portions are introduced from the outside in the radial direction into the chambers The bottom of the latter is a ram head of a radially moveable ram. During the rotational movement, the ram or ram head is moved outwards in the radial direction. Due to contact with an outer guide, the portion is mechanically compressed. Thereafter, due to further radial movement of the rams, an ejecting movement of the portion from the chamber into the open, co-running pocket takes place.

Thereafter, the filled strand is closed by a continuous longitudinal seam. In the area of a severing station, the individual packs are formed by severing from the strand by severing cuts in the region of transverse seams.

Further features of the invention relate to processes for producing and filling the packs and to details of the apparatus.

BRIEF DESCRIPTION OF THE DRAWINGS

An exemplary embodiment of the apparatus is explained in further detail below with reference to the drawings, in which.

DETAILED DESCRIPTION OF THE PREFERRED EMBODIMENTS

Figure 1:
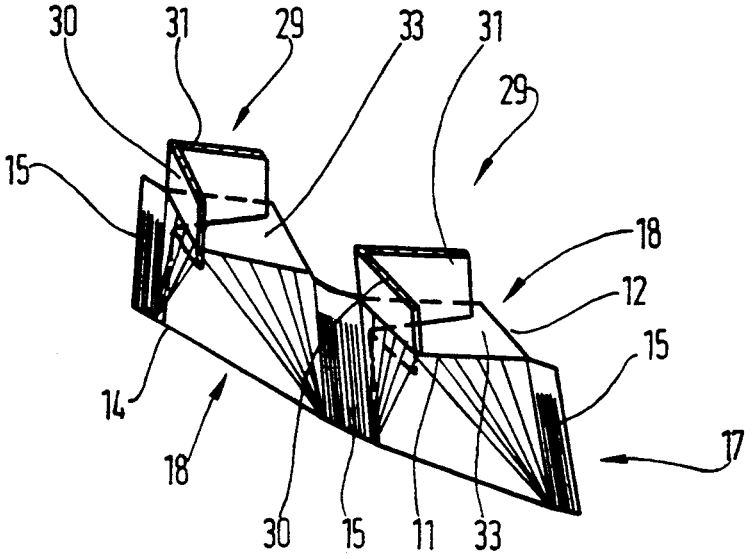
FIG. 1 shows a section of a strand with pockets, open at the side, in the position opened by spreading members, in a perspective representation.
Figure 2:
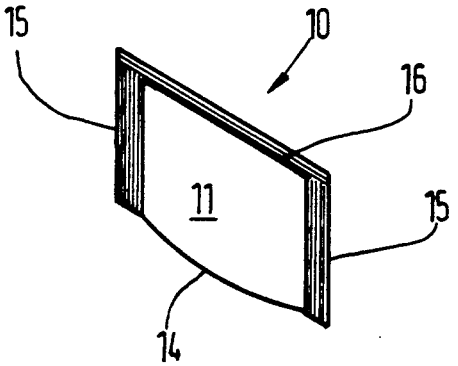
FIG. 2 shows a complete pack in perspective representation.

The exemplary embodiment represented in the drawings concerns the production of packs 10 from thin packaging material, in particular from a liquid-permeable nonwoven material. The cushion-shaped pack 10 consists of two pack walls 11 and 12. These are joined together all around. In the present case, the pack walls 11, 12 are joined together by means of a folding edge 14, formed by folding of a double-width material web 13 in the form of a V, as well as by transverse seams 15 and a longitudinal seam 16. These seams may be produced by adhesion or by (thermal) sealing of the possibly coated pack walls 11, 12.

The pack 10 of such design serves in particular for receiving chewing tobacco (substitute).

Figure 4:
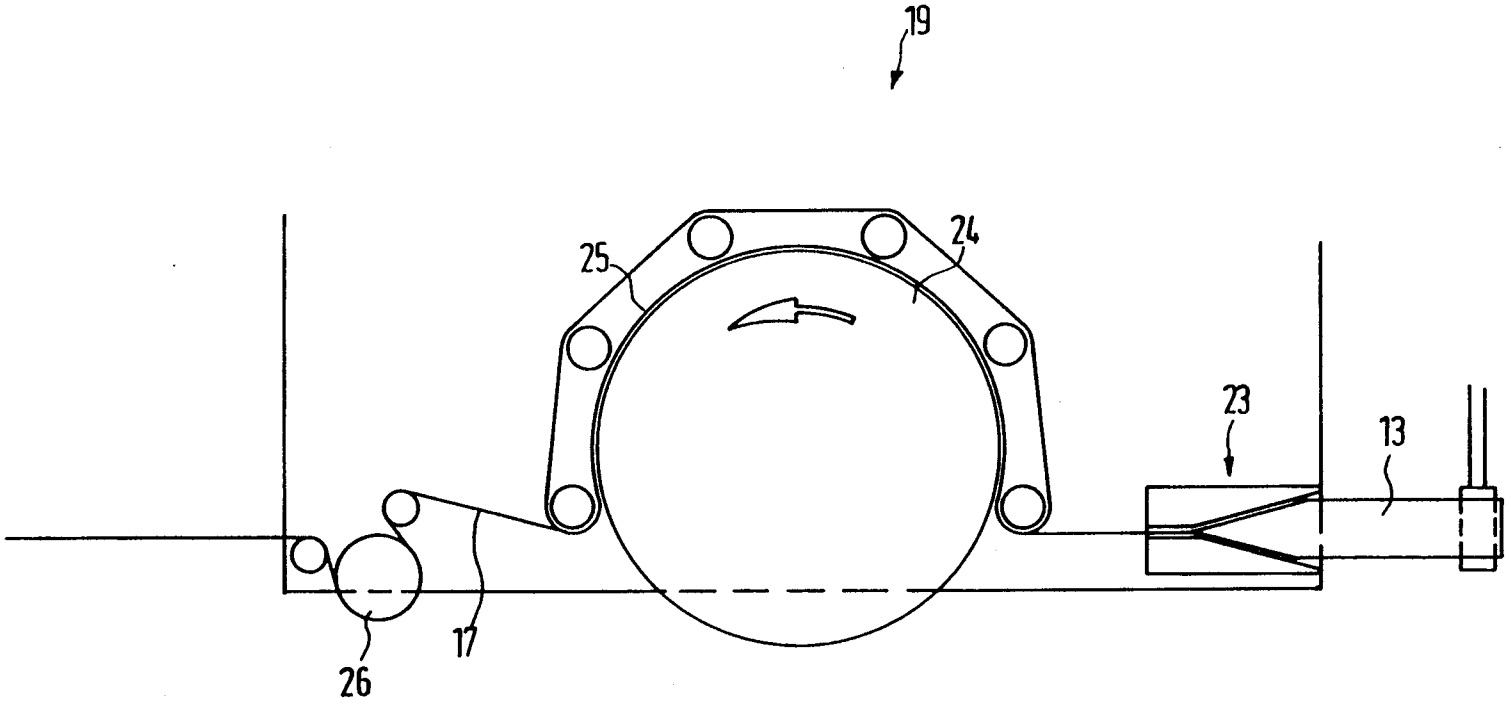
FIG. 4 shows a unit for producing a continuous strand of pockets, open on one side, in diagrammatic side view according to arrow direction IV in FIG. 3.

For producing and filling the packs 10, firstly a strand 17 of pockets 18, open on one side, is formed from the web of material 13, to be precise in a strand station 19 (FIG. 4). The strand 17 then passes into a filling station 20, in which portions 21 are filled into the pockets 18 of the strand 17. In the area of a subsequent sealing station 22, the pockets 18 are closed by applying the longitudinal seam 16 and individual packs 10 are produced by being severed from the strand 17.

In the area of the strand station 19 (FIG. 4), a (double-width) web of material 13 is folded in the form of a V by a known folding member 23 and then fed as a double-ply web to a sealing apparatus, namely a sealing wheel 24. The latter is provided on the outside circumference with rib-shaped or strip-shaped sealing members, directed transversely with respect to the web of material 13 and not shown in detail. These members produce the transverse seams 15 on the basis of heat and pressure by the contact of the web of material 13 with the circumference of the sealing wheel 24. For this purpose, the double-ply web of material 13 is pressed by a pressing member, namely by a pressing band 25, against a partial region of the circumference of the sealing wheel 24.

The strand 17 thereby produced is led via deflection rollers and via a control roller 26. The latter controls the drive of the sealing wheel 24 to compensate for elongations and other irregularities in the transporting of the web of material 13.

Figure 3:
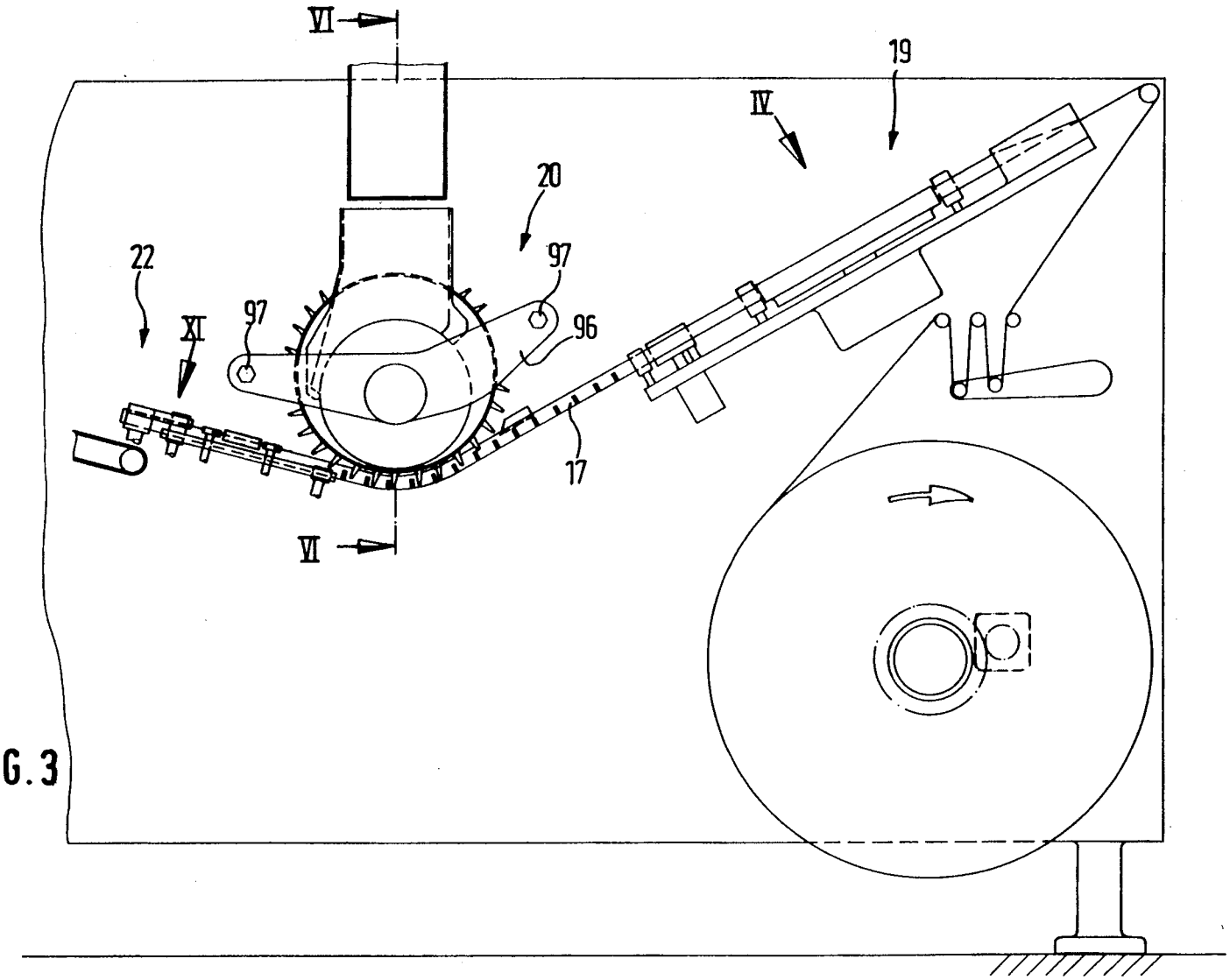
FIG. 3 shows the complete apparatus in diagrammatic side view.

In the case of the exemplary embodiment shown (FIG. 3), the sealing wheel 24 is mounted rotatingly in an inclined plane. The arrangement is made such that the strand 17 is fed running in an upright plane to the filling station 20. The strand 17 is taken in a tangential direction to the outer circumference of an annular filling member, namely to a spreading ring 27. In the specific exemplary embodiment, the latter is designed as hollow cylinder 28 (FIG. 6) and is rotatingly mounted on one side. The spreading ring 27 is formed on the free edge of the hollow cylinder 28.

The object of the spreading ring 27 is to open the pockets 18 of the strand 17 and to permit the introduction, namely pushing-in, of a portion 21 of the filling material into a filling opening 33 of the pocket 18. For this purpose, spreading members 29 are attached at intervals from one another on the circumference of the hollow cylinder 28. These consist of two spreading legs 30, 31, arranged at an acute angle to each other. The width of the spreading legs 30, 31 decreases outwards in the radial direction, so that the spreading members 29 taper to the outer-lying end, first entering the pockets 18.

The spreading members 29 are arranged on the circumference of the spreading ring 27 in such a way that, at a co-ordinated, synchronously controlled conveying speed of strand 17 and rotating speed of spreading ring 27, in each case one spreading member 29 enters into one pocket 18. The relative position is chosen such that the spreading legs 30, 31, running together forwards in the direction of rotation, enter a forwardly directed edge region of the pocket 18, adjacent to the front-lying transverse seam 15, namely into the region of a folding edge 14 formed there. This provides an optimum widening of the pocket 18.

For a limited circumferential region, the strand 17 bears circularly against the spreading ring 27, namely in the region of a filling zone 32. In this region, the portions 21 are pushed in the radial direction through the spreading ring 27 into the respectively assigned pocket 18 in the radial direction. For this purpose, the spreading ring 27 is provided in the region of the spreading members 29 with through-openings 34. The portions 21 are thereby moved through between the spreading legs 30, 31 of the spreading member 29.

The strand 17 thus filled is subsequently closed in a continuous operation by the longitudinal seam 16 applied at the side. Then, in the region of the double-width transverse seam 16, a severing cut is made in each case between adjacent pockets 18 or packs 10, producing the complete, closed pack 10.

Consequently, production and filling of the packs 10 take place with continuous transporting of the web of material 13 or of the strand 17. For this purpose, the apparatus is equipped with two conveying members, co-ordinated with each other with regard to their movement, for the strand 17 on the one hand and for the portions 21 on the other hand. During the relatively short filling zone 32, the two conveyors run synchronously to each other in such a way that the portions 21 can be pushed in the radial direction into the open pockets 18 over a very short radial pushing-in displacement.

One of these conveyors is the spreading ring 27, which provides for an exact positioning of the strand 17 and opening of the pockets 18 in the region of the filling zone 32. The portions 21 are formed and transported by a likewise circular, rotatingly revolving conveyor, namely by a portion turret 35. The portion turret 35, designed in the form of a disc (FIG. 6), is arranged with an offset axis of rotation with respect to the spreading ring 27. The latter has a larger diameter. The relative position is such that the portion turret 35 lies with an offset axis of rotation within the spreading ring 27.

The portion turret 35 has the object of taking over portions 21 from a material supply 36, transporting them, formatting or compressing them and then transferring them to a pocket 18 of the strand 17. In the region of the filling zone 32, spreading ring 27 and portion turret 35 lie at a minimal distance from each other, so that the portions 21 are conveyed over a short radial displacement.

The portion turret 35 is provided with a plurality of receptacles distributed at equal intervals along the circumference, each for a portion 21. In the present case, these are cylindrical or cross-sectionally square or rectangular chambers 37. These extend in the radial direction and are open on the outer circumferential side of the portion turret 35. On the inside, a bottom of the chamber 37 is formed by a part of a slide member, namely by a ram head 38 of a ram 39. Each chamber 7 is assigned such a ram 39. The ram head 38, moveable in the radial direction within the chamber 37, almost completely fills the cross section of the chamber 37.

The rams 39 are mounted displaceably by ram rods 40 in radially directed bores 41 of the portion turret 35. For carrying out radial movements, sensing members, namely lateral, transversely directed lugs 42, are attached to the ram rods 40. These enter an annularly encircling control groove 43 of a stationary control disc 44. The shape of the control groove 43 has the effect that, upon the rotational movement of the portion turret 35, a radially directed movement of the lugs 42, and thus of the rams 39, takes place. The corresponding movement of the lugs 42 is made possible by a slit 45 in the portion turret 35.

Due to the relative position of the portion turret 35 within the spreading ring 27, a larger free space is created in the upper region of the same. This serves as collecting space 46 for the material supply 36. The arrangement is made such that the material supply 36 is predominantly located in the region of the collecting space 46 above the portion turret 35. The fibrous material therefore rests on the chambers 37 facing with their openings upwards. The collecting space 46 is bounded by a fixed housing 47 which is designed in the form of a funnel and hugs the circumference of the portion turret 35.

Figure 5:
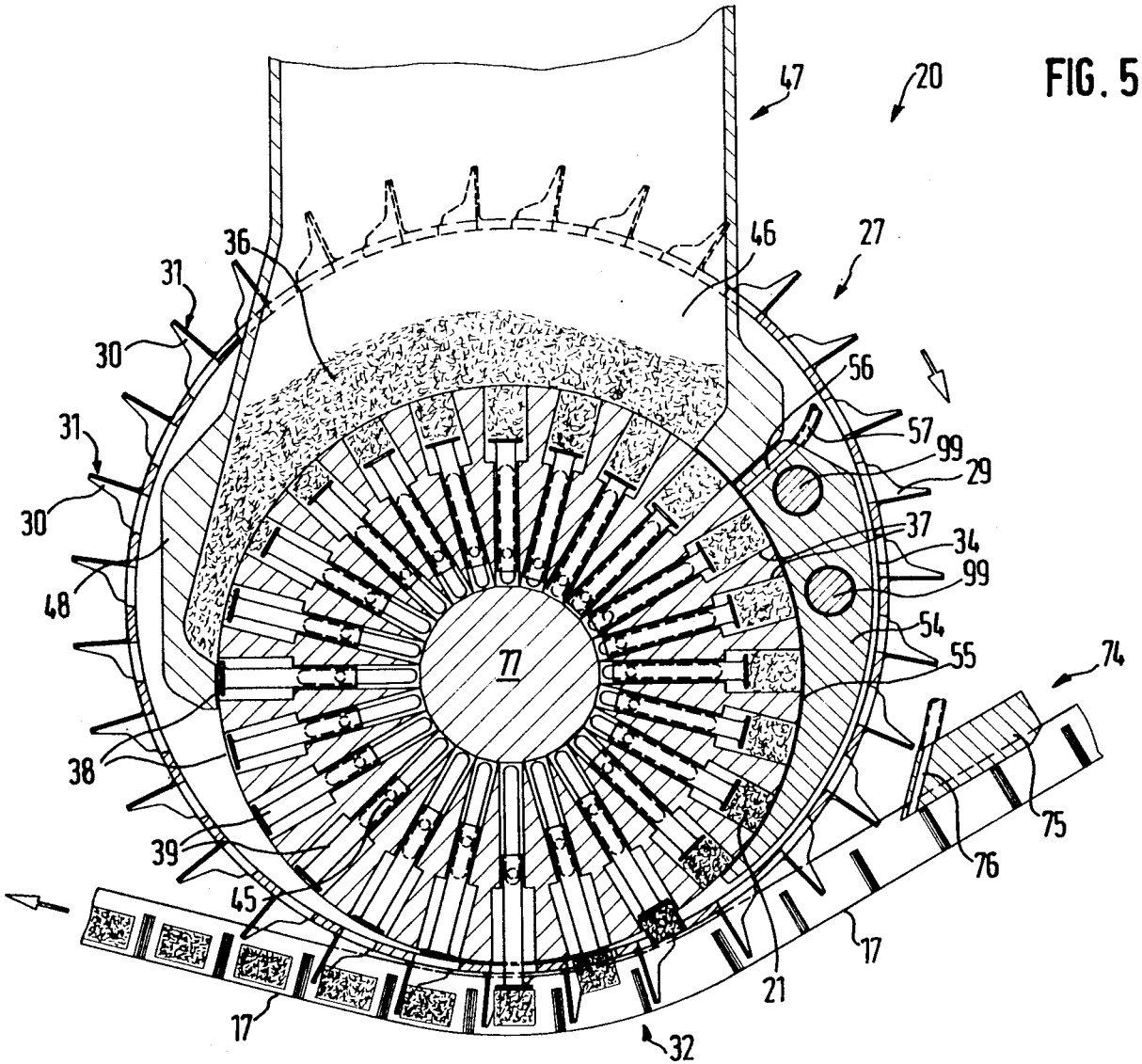
FIG. 5 shows the most important details of the apparatus in side view and in vertical section (sectional plane V—V in FIG. 6)

The housing 47 is designed for the formation of a correspondingly shaped collecting chamber 46 (FIG. 5) such that a rearward side wall 48, in the direction of rotation of the portion turret 35, extends virtually as far as the level of a horizontal center plane of the portion turret 35. This provides an approximately upright region of the collecting space 46. This is where the filling operation for the chambers 37 already begins. The rams 39, or the ram heads 38, are here initially in a virtually flush position with the outside surface of the portion turret 35. By radial movement inwards, the ram head 38 is increasingly withdrawn further, so that the chamber 37 becomes more and more free for receiving the portion 21. To a corresponding extent, fibrous packing material enters the chambers 37.

The fibrous material passes by its own weight together with the effect of vibration into the chambers 37. The housing 47 is subjected to vibration. In the case of the present exemplary embodiment (FIG. 6), an extension 49 is fitted to the housing 47 in the lower region. A horizontally directed push rod 50 is connected to this extension. The said push rod is mounted in a sliding manner in a bearing 51 of a stationary housing part, namely a hub 52. The push rod 50 is subjected to vibration in the axial direction by a corresponding drive member. A corresponding vibrational movement is transmitted to the housing 47.

The fibrous packing material passes via a conveying trough 53 into the housing 47, open at the top. The conveying trough 53 is also expediently subjected to vibration (shaking trough). As a result, a material which has altogether been loosened considerably is fed in.

In order to achieve a substantially constant filling pressure in the area of the collecting chamber 46, the latter is filled only partially with fibrous material. The filling level is monitored in a suitable way (light barrier).

When the chamber 37, filled with a metered portion 21, leaves the area of the collecting chamber 46, a phase of compressing the portion 21 takes place. For this purpose, the rams 39 with ram head 38 are moved outwards in the radial direction by corresponding shaping of the control groove 43. A fixed segment 54, which is mounted fixedly on the outer circumference of the portion turret 35, serves as counter-pressing member for the ram head 38. A pressure surface 55, facing towards the circumference of the portion turret 35, is shaped in the form of a circular arc or part-cylinder and hugs the circumference of the portion turret 35. The portions 21, under pressure, slide along the pressure surface 55.

The segment 54 extends into the region of the filling zone. When a chamber 37 leaves the region of the segment 54, the filling operation begins. An open pocket 18 is located opposite a chamber 37, so that the compressed portion 21 is pushed by continued radial movement of the ram 39 through the spreading ring 27 into the pocket 18. Upon the further rotational movement, the ram 39 is again withdrawn, to be precise initially to the flush position of the ram head 38 with the circumference of the portion turret 35.

A special feature is that, before closing of the pockets 18 or before filling the latter, the portions 21 are fed a liquid by spraying. In the case of the present exemplary embodiment (FIG. 5), the liquid is introduced into the portion 21 already before the beginning of compression, whereby a particularly good distribution is ensured. The liquid is, in particular, water. However, other liquid substances, for example flavourings, preservatives, etc. can also be introduced into the portion 21 in this way.

For this purpose, a spraying member, namely a spraying nozzle 56, is arranged stationarily alongside the circumference of the portion turret 35. This spraying nozzle is directed radially at the open side of the chamber 37. In the present case, the spraying nozzle 56 is arranged as a bore in the segment 54 at the beginning of the compression zone. The liquid is fed via a hose line 57.

The strand 17 filled in the way described is fed to the sealing station 22. The strand 17 leaves the circumference of the spreading ring 27 in a tangential direction and runs in a straight line through the sealing station 22. In so doing, the longitudinal seam 16 is produced continuously at the edge of the strand 17.

Figure 10:
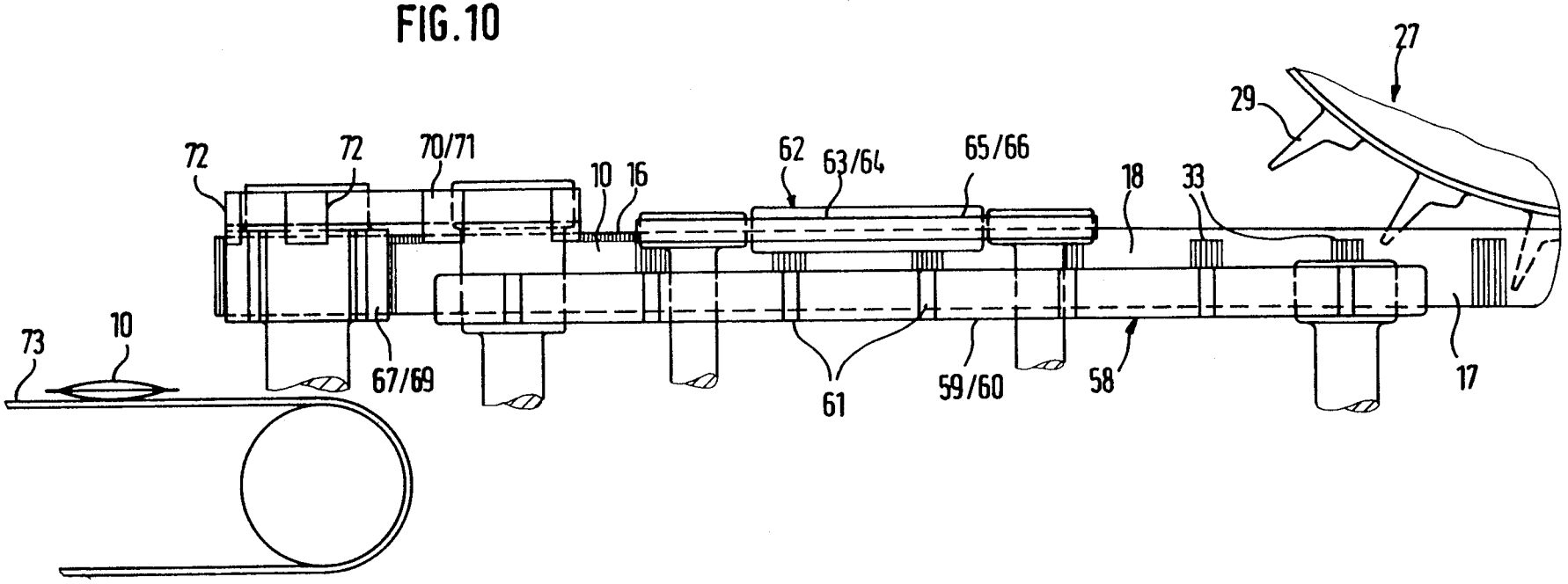
FIG. 10 shows a severing station for producing individual packs from a strand in side view.
Figure 11:
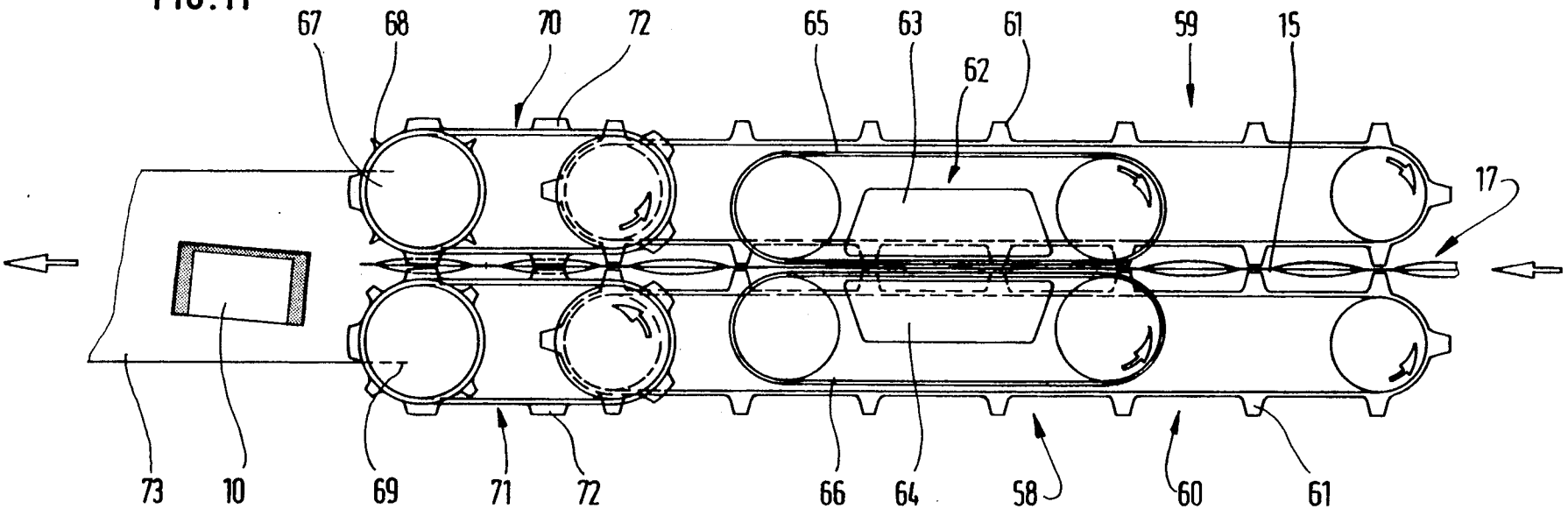
FIG. 11 shows the detail of FIG. 10 in plan form, according to arrow direction XI in FIG. 3.

In the case of the present exemplary embodiment, the strand 17 is taken up by a belt conveyor 58 immediately after leaving the spreading ring 25 (FIGS. 10 and 11). This belt conveyor consists of two conveyor belts 59, 60, which circulate in an upright plane on both sides of the strand 17. The conveyor belts 59, 60 are provided with outwardly facing rib-like projections 61, to be precise at such intervals that the strand 17 is taken up in the region of the transverse seams 15 on both sides by the projections 61 and transported.

As can be seen in particular from FIG. 10, the conveyor belts 59, 60 take up the strand 17 in a region which is low or lying remote from the filling opening 33. As a result, a sealing member 62 can come into effect at the edge of the strand 17 facing the filling opening 33—above the belt conveyor 58. This sealing member consists of two mutually moveable heating elements 63, 64, which are arranged on opposite sides of the strand 17 and which, in the pressed-together position, produce the longitudinal seam 16 over a section of the strand 17.

The heating elements 63, 64 do not come directly into contact with the strand 17 but with the intermediate belts 65, 66. Pressure and heat are transmitted through the intermediate belts 65, 66, driven continuously in the direction of conveyance, to the strand 17, so that the longitudinal seam 16 is produced during the continuous conveying movement of the strand 17.

The strand 17 thus consisting of joined-together packs 10 then passes into the area of a cutter roller 67 having a plurality of severing cutters 68 arranged along the circumference. Their distance from one another corresponds to the dimension of the pack 10 in such a way that a severing cut is executed in each case in the central region of a double-width transverse seam 15.

The cutter roller 67 is assigned a counter-roller 69 on the opposite side of the strand.

In the area of the cutter roller 67 as well, the strand 17 is transported and guided continuously. For this purpose, the belt conveyor 58 is adjoined by end conveyors 70, 71, designed as conveyor belts. These engage opposite sides of the strand 17 in the upper region of the same, that is to say at the longitudinal seam 16. The two end conveyors 70, 71 have catches, namely bulge-like projections 72, on the side facing the strand 17. These projections engage the strand 17 in a region between adjacent transverse seams 15. As a result, the severing cut can be carried out undisturbed in the region of the transverse seams 15. Deflecting rollers for the end conveyors 70, 71 are mounted on the one hand coaxially with the cutter roller 67 and the counter-roller 69 and on the other hand coaxially with deflecting rollers of the conveyor belts 59, 60. As a result, an uninterrupted restricted guidance of the unstable strand 17 is ensured.

The severed packs 10 drop onto a delivery belt 73.

The members of the filling station 20 are equipped with a number of further special features.

In order to facilitate the opening or spreading of the pockets 18 in the intake region of the filling station 20, a stationary strand opener 74 is arranged there. This consists of a wedge-shaped spreading shoe 75, which enters with the lower, thinly tapering region into the upper or free region of the strand 17. As a result, the free region of the strand 17, to which the transverse seams 15 are not applied, is opened. The transverse seams 15 end at a distance from the free edge of the strand 17, that is to say are shorter than the width of the same, to be precise corresponding to the width of the (later applied) longitudinal seam 16.

Furthermore, the strand opener 74 is provided with a blowing nozzle 76. Through this, air is passed into the strand 17 opened by the spreading shoe 75. The blowing nozzle 76 is located at a region of the strand opener 74 lying forward in the direction of conveyance. The blowing nozzle 76 is inclined, namely pointing in the direction of conveyance. Immediately in the region of the blowing nozzle 76, a spreading member 29 enters thereafter the pocket 18 opened by the blowing air.

A further special feature is the adjustability of the control disc 44, such that the relative position of the control groove 43 changes with respect to the rams 39. As a result, the amplitude of movement of the rams 39 is variable.

The control disc 44 is arranged offset, that is to say axially parallel with respect to a main shaft 77, on which the portion turret 35 is mounted. The control disc 44, is, for its part, able to swivel about a stationary, offset pivot bearing 78. The latter is in turn located on a supporting plate 79 as a fixed part of the pivot bearing 78. A bearing journal 80, which is connected (indirectly) to the control disc 34, is held rotatably on the supporting plate 79 by a bearing sleeve 81.

The thus designed swivel bearing for the control disc 44 is provided with a supporting web 82, which is fixedly connected to the control disc 44. With corresponding adjustment, the latter can execute a swivelling movement about the pivot bearing 78.

At a region of the control disc 44 lying remote from the pivot bearing 78 there is arranged an adjusting mechanism 83 for the said disc. A guide piece 84 with slot 85 is fixedly attached to one side of the control disc 44. By means of the guide piece 84, adjusting movements are transmitted to the control disc 44, to be precise by an adjusting member in the form of a swivelling adjusting lever 86, which enters with an adjusting lug 87 into the slot 85. The adjusting lever 86 can be swivelled by an actuating shaft 88, namely between the end positions shown by solid lines and dot-dashed lines. As a result, a corresponding adjustment of the control disc 44 is brought about by swivelling about the pivot bearing 78.

The end positions of the control disc 44 are fixed, to be precise by a ball catcher 89, which in the end positions enters in each case into a depression 90 of the control disc 44. The ball catcher 89 is attached to a supporting arm 91 of the supporting plate 79.

Figure 6:
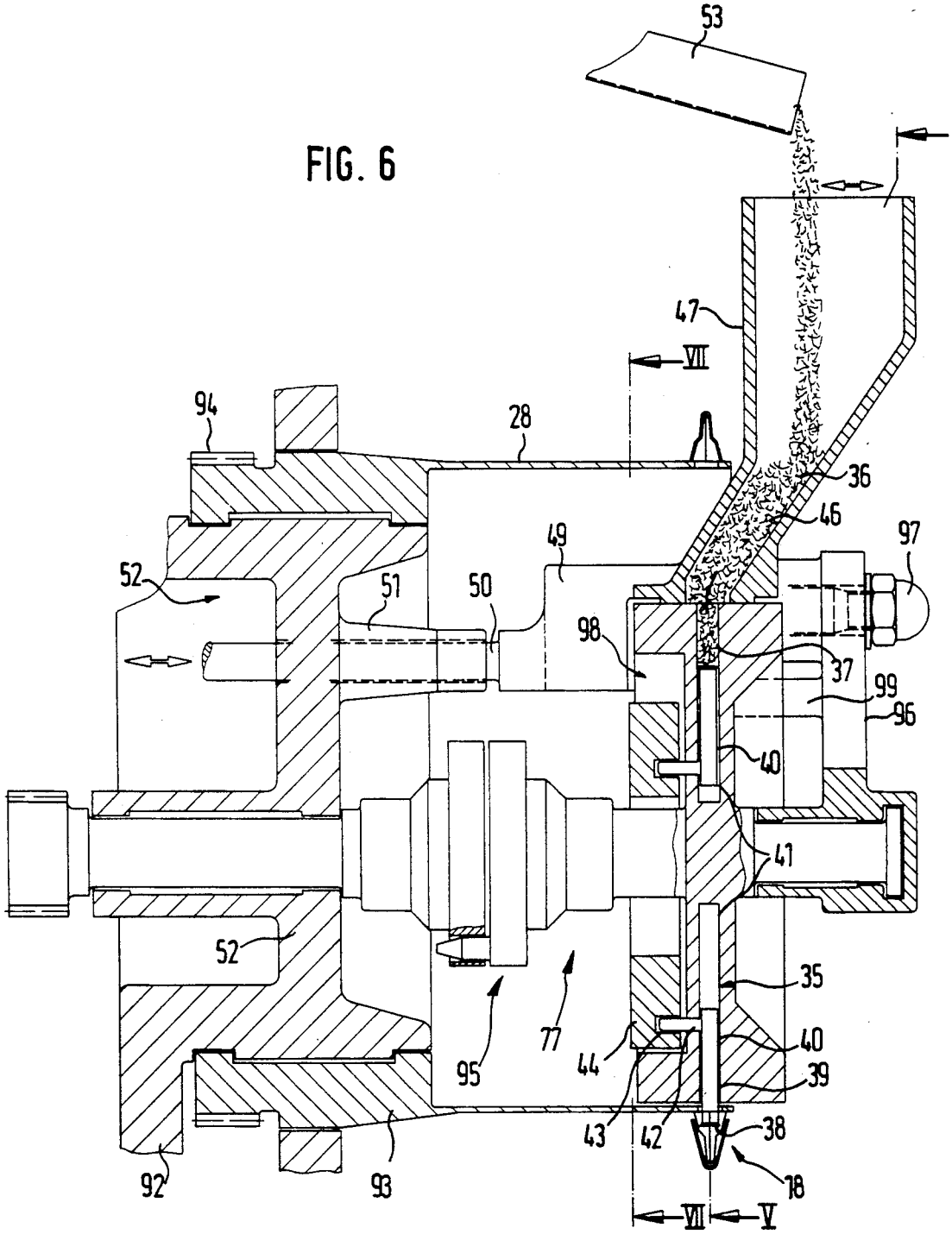
FIG. 6 shows the apparatus in a longitudinal or axial section.
Figure 7:
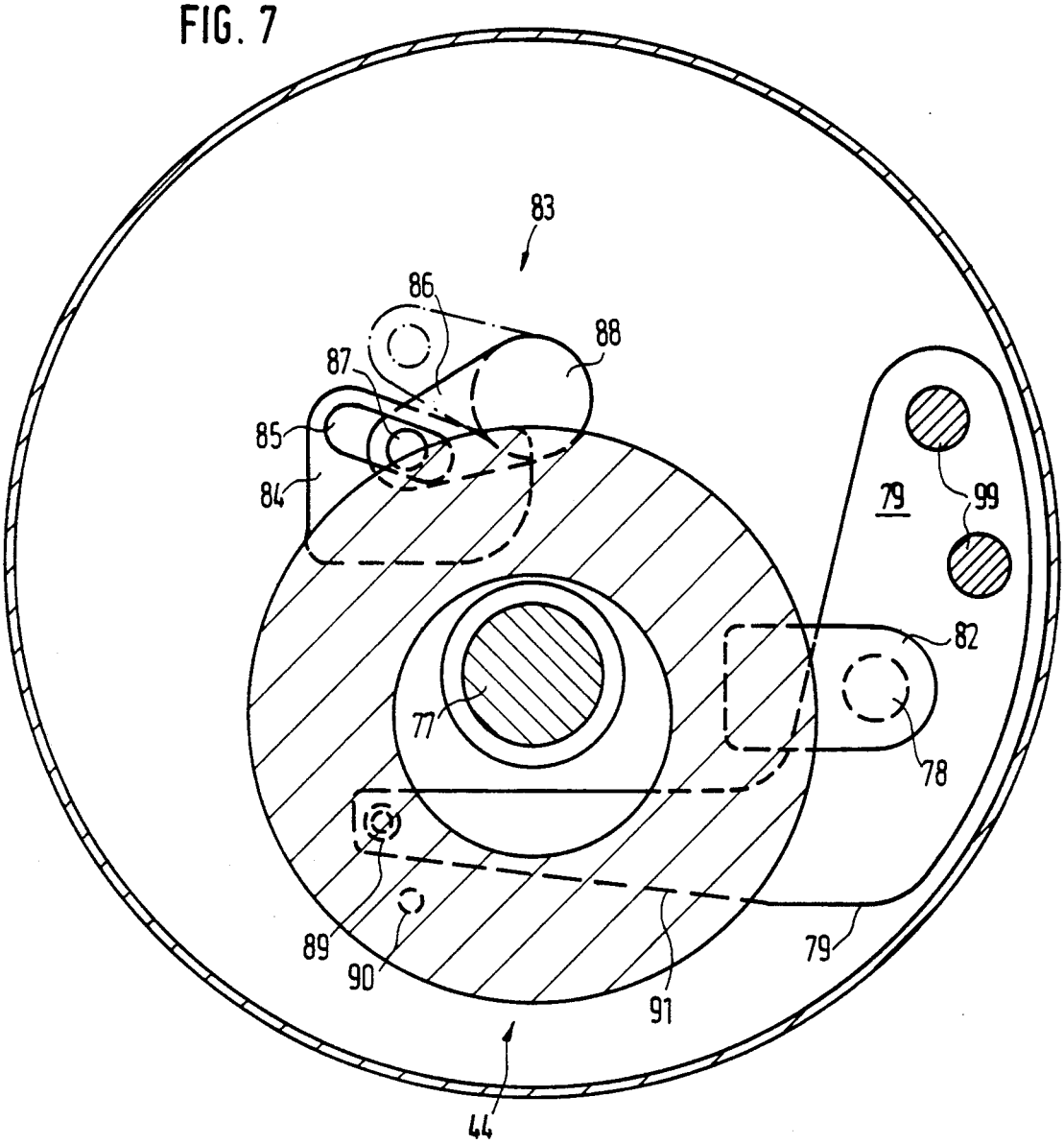
FIG. 7 shows a detail of the apparatus, namely a control disc in a sectional plane according to VII—VII of FIG. 6.
Figures 8, 9:
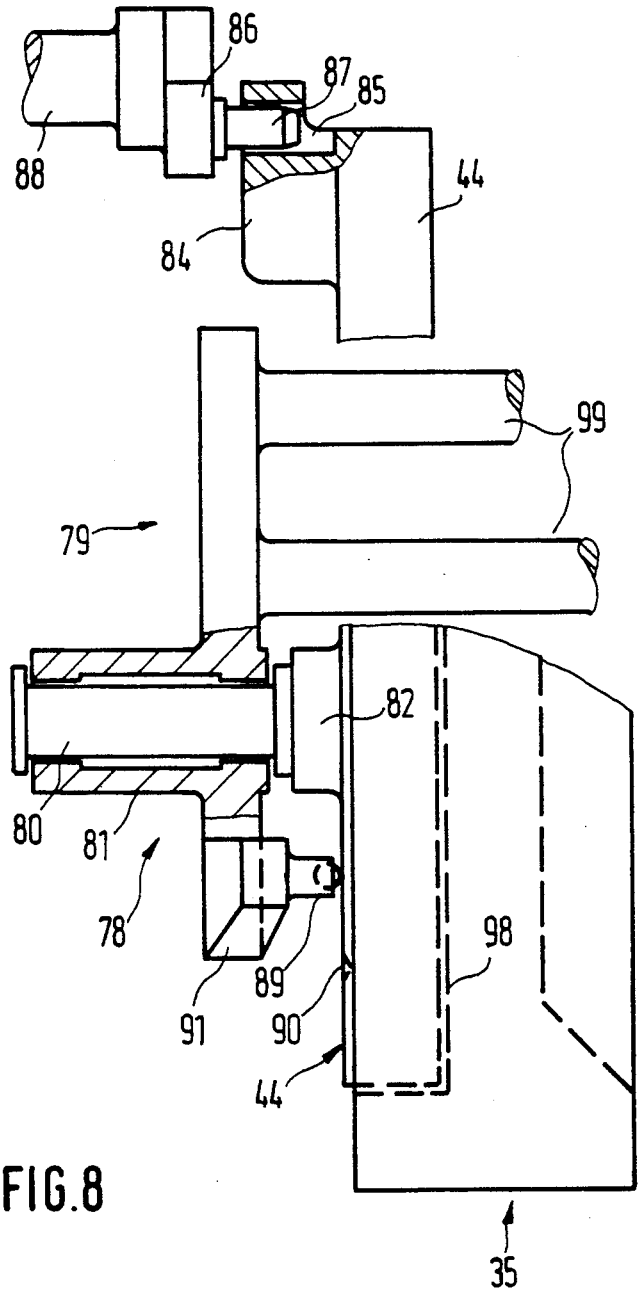
FIG. 8 shows a further detail of the control disc, namely an adjusting mechanism of the same, in transverse view or in axial section.
FIG. 9 shows a detail of an adjusting mechanism for the control disc in side view.

As can be seen in particular from FIG. 6, the most important members of the filling station 20 are nested one inside the other. The hollow cylinder 28, on the free end of which the spreading ring 27 is formed, encloses partial regions of the portion turret 35 and of the drive (main shaft 77). The main shaft 77 is rotatably mounted in a stationary supporting member, namely in the hub 52, which for its part is connected to a machine frame 92.

A cylindrical extension 93 of the hollow cylinder 28 is rotatably mounted on the circumference of the hub 52. The extension 93, and consequently the hollow cylinder 28 with spreading ring 27, are driven via a gear rim 94. The gear rim 94 and the hub 52 are mounted offset or axially parallel with respect to the main shaft 77.

An important special feature is that the members of the filling station 20, combined to form a unit, can be taken apart in a simple way for cleaning and repair purposes. The portion turret 35, the control disc 44 and a portion of the main shaft 77 facing towards these members can be separated from the other members and be withdrawn from the region of the hollow cylinder 28. For this purpose, the main shaft 77 is divided. A shaft coupling 95 of suitable design, lying within the hollow cylinder 28, makes it possible to divide the main shaft 77.

In the operating position shown in FIG. 6, the members are secured by a cross-piece 96 (FIG. 3), extending at the face lying on the right in FIG. 6. This cross-piece 96 also supports the free end, projecting beyond the portion turret 35, of the main shaft 77. The cross-piece 96 projects laterally beyond the spreading ring 27. Axially parallel retaining bolts 97 connect the cross-piece 96 to a part of the machine frame 92. By loosening the retaining bolts 97, the cross-piece 96 can be removed with the members described further above.

In order that the rams 39 do not impede the removal and reassembly of the members described, the control disc 44 is previously adjusted in the way described to such an extent that all of the rams 39 lie within the circumferential area of the portion turret 35.

The control disc 44 lying in a recess 89 of the portion turret 35 is divided by the associated adjusting mechanism 83. The latter remains in the position within the hollow cylinder 28. The guide piece 84 connected with the control disc 44 is drawn off the adjusting lug 87 during removal.

The supporting plate 79 acting as a retaining member for the control disc 44 is linked to the cross-piece 96 via supporting rods 99. The segment 54 is mounted on these supporting rods 99 as well, so that it can be taken off together with the described members.

We claim:

1. A process for producing bag-like packs (10) for housing fibrous filling material, comprising the steps of:

forming a continuous strand (17) of unilaterally open pockets (18) from a web of packaging material, said pockets being separated from one another by transverse seams (15);

filling each of said pockets with a portion (21) of said filling material at a filling zone (32);

closing the pockets with a closure seam extending in a longitudinal direction; and severing the closed pockets from the strand (17) in the region of the transverse seams (15) by means of severing cuts, and continuously transporting the portion (21) of the filing material synchronously with corresponding pockets (10) of the strand;

during transport, compressing said portions (21) prior to their being inserted into the pockets (18) such that said portions have a configuration corresponding to the volume of the pockets (18), subsequently the formed portions (21) and the strand (17) with the open pockets (18) are transported synchronously and spaced a predetermined distance apart along said filling zone (32); and during transport of the portions (21) and the strand (17) in the region of the filing zone (32), introducing the formed portions (21) into corresponding open pockets (18) by a transverse movement; and wherein said portions are transported along a circular transporting path, and during transport the portions (21) are compressed by radially outwardly directed pressure and, in an outwardly directed radial movement, are introduced into respective packs (10) by being pushed into the packs (10) which are conveyed along a coaxial circular path at least during a transfer zone.

2. A process according to claim 1, further comprising the step of spraying the portions (21) of the filling material with a liquid before the portions (21) are compressed.

3. A process according to claim 1, further comprising the step of forming the strand (17) of packs (10) from a web of material (13) having a predetermined width, folded in a V-shape and having said transverse seams (15) for lateral bounding of the packs (10), the pockets (18) of packs (10) having been joined together being spread apart by blowing air for filling pockets (18) with the portions (21) or for introducing a spreading member (29) into said pockets (18) in the area of said filling zone (32).

4. A process according to claim 3, wherein the transverse seams (15) have an end which is spaced a predetermined distance away from a free, open edge of the web of material (13) folded into a V-shape, such that the web of material (13) outside the region of the transverse seams (15) includes throughout two plies which are not joined together.

5. An apparatus for producing bag-like packs (10) from two pack walls (11, 12), joined together around the edges thereof, adapted to accommodate portions of fibrous filling material, comprising: means for forming a continuous strand (17) of packets (18), open at a side, from a web of material (13);

means for filling each of said pockets along a longitudinal seam (16) with a portion (21) of the filling material at a filling zone (32);

means for closing the pockets (18) after said pockets have been filled to form respective packs (10);

means for severing said packs from the strand (17) by severing cuts; and a continuously driven portion conveyor;

wherein the portions (21) to be packed are transported by said continuously driven portion conveyor into the region of said filling zone (32) at a predetermined distance from the open pockets (18) of the portion conveyor, said apparatus further comprising a pushing member (39), the portions (21) being pushed by said pushing member (39) from the portion conveyor in an outwardly directed movement into the pockets (18);

wherein said portion conveyor comprises a rotatable portion turret (35), the portion turret (35) having a plurality of changers (37), each for receiving a portion (21), the chambers (37) having slide members arranged therein which is moveable in a radial direction, said slide members each comprising a ram (39) having a ram head (38) forming an inner bottom portion of a respective chamber (37); and wherein said portion turret includes radial bores (41) formed therein, said apparatus further comprising ram rods (40), wherein said rams (39) are mounted displaceably in the radial direction with the ram rods (40) in the radial bores (41) of the portion turret (35), and wherein said apparatus further comprises at least one of a control cam and a stationary control disc having a control groove (43), the radial movement of the rams (39) being controllable by said at least one of said control cam and said control groove (43) of said stationary control disc (44) such that the rams (39) are selectively movable for filling the portions (21), until in a filling opening (33) of the pockets (18).

6. An apparatus according to claim 5, wherein the control disc (44) includes means for adjusting said control disc such that an amplitude of movement of the rams (39) is changed.

7. An apparatus according to claim 5, further comprising a shaft coupling (95) and a filling station (20) including said portion turret (35) and a main shaft (77), wherein the portion turret (35) with said control disc (44) and a portion of said main shaft (77) are removable by said shaft coupling (95), said apparatus further comprising an outwardly attached retaining member and a machine frame, the portion turret (35) with said control disc (44) and said main shaft having been removed being retained in a working position by said outwardly attached retaining member, wherein said outwardly attached retaining member comprises a cross-piece (96) fastened on the machine frame by a retaining bolt (97).

8. An apparatus for producing bag-like packs (10) from two pack walls (11, 12), joined together around the edges thereof, adapted to accommodate portions of fibrous filing material, comprising: means for forming a continuous strand (17) of pockets (18), open at a side, from a web of material (13):

means for filling each of said pockets along a longitudinal seam (16) with a portion (21) of the filling material at a filling zone (32);

means for closing the pockets (18) after said pockets have been filled to form respective packs (10);

means for severing said packs from the strand (17) by severing cuts; and a continuously driven portion conveyor;

wherein the portions (21) to be packed are transported by said continuously driven portion conveyor into the region of said filling zone (32) at a predetermined distance from the open pockets (18) of the portion conveyor, said apparatus further comprising a pushing member (39), the portions (21) being pushed by said pushing member (39) from the portion conveyor in an outwardly directed movement into the pockets (18);

wherein said portion conveyor comprises a rotatable portion turret (35), the portion turret (35) having a plurality of chambers (37), each for receiving a portion (21), the chambers (37) having slide members arranged therein which is moveable in a radial direction, said slide members each comprising a ram (39) having a ram head (38) forming an inner bottom portion of a respective chamber (37);

said apparatus further comprising means for compressing said portions (21), said compressing means including said rams (39), wherein before said portions (21) are pushed into the pockets (18), the portions (21) in the chambers (37) are compressed by radial movement of the rams (39) having said ram heads (38) in the outward direction during rotational movement of the portion turret (35).

9. An apparatus according to claim 8, wherein the fibrous filling material is introducible into the upwardly opening chambers (37) of the portion turret (35) by its own weight and by vibration, and further comprising means for rotating said portion turret (35), wherein an upper region of the portion turret (35), revolving in the vertical plane, includes a housing (47), said housing opening towards the circumference of the portion turret (35) and being vibratingly movable.

10. An apparatus according to claim 8, further comprising a spreading ring (27) surrounding the portion turret, wherein the web of material (13) folded in a V-form is supported, at least in the region of the filling zone (32), against an outer circumference of said spreading ring (27) surrounding the portion turret (35), the spreading ring (27) having spreading members (29) arranged on the circumference of the spreading ring, said spreading members (29) comprising spreading legs (30, 31) arranged at an acute angle to each other and extending within filling openings (33) of each pocket (18).

11. An apparatus according to claim 10, further comprising a cover extending at the circumference of the position turret (35), wherein the chambers (37), open on a radially outerlying side of the portion turret (35), are closed along a partial region of one revolution by said cover extending at the circumference of the portion turret (35), said cover including a stationary segment (54) which hugs a partially cylindrical pressure surface (55) at the circumference of the portion turret (35) such that the chambers (37) are closed on the radially outerlying side adjacent the segment (54).

12. An apparatus according to claim 11, wherein said spreading ring includes a through-opening formed therein, and wherein after the portions (21) have been compressed in the area of the filling zone (32), said rams (39) pushing said portions (21) in the radical direction out of the chambers (37) and through said through-opening (34) in the spreading ring (27) into an open pocket (18).

13. An apparatus according to claim 10, further comprising a stationary opening member arranged immediately ahead of a feeding of the strand (17) at the outer circumference of the spreading ring (27), said stationary opening member including means for opening a facing side of the strand (17) or a facing side of the pockets (18), said apparatuses further comprising a blowing nozzle (76) directed into the pockets (18).

14. An apparatus according to claim 13, further comprising end conveyors (70, 71) each having a projection (72), and a plurality of radially directed severing cutters (68) arranged on a revolving cutter roller (67), such that upon rotation of the cutter roller (67) a severing cut is made in the region of a transverse seam (15) of each of the filled pockets, the strand being transportable by said end conveyors (70, 71) which take up the strand (17) with said projections (72) in the region outside the transverse seams (15) in a region of said longitudinal seam (16) of the pocket (18).

15. An apparatus according to claim 10, further comprising a straight belt conveyor (58) having rib-like projections (61), wherein said strand (17) with said pockets (18) having been filled is drawn off in a tangential direction from the spreading ring (27) in a lower region of the spreading ring by said straight belt conveyor (58), and wherein said conveyor (58) takes up and transports the strand (17) in a region of the transverse seams (15) by said rib-like projections (61).

16. An apparatus according to claim 15, further comprising a sealing member (62), a straight conveying zone of said strand, and means for continuously producing said longitudinal seam (16) for closing the pockets (18) in a region of said straight conveying zone of the strand (17), said sealing member (62) being operable outside the area of the belt conveyor (58).

17. An apparatus according to claim 16, further comprising an intermediate belt (65, 66), wherein the sealing member (62) comprises two mutually moveable heating elements (63, 64) arranged on first and second sides of the strand (17) which act on said intermediate belt (65, 66) facing the strand (17), said heating elements (63, 64) being movable with the strand (17).

18. An apparatus according to claim 87, further comprising a fixed spraying nozzle, wherein the portion turret (35) is adapted for use with said fixed spraying nozzle (56) for introducing liquids into the portions (21) located in the chambers (37), the spraying nozzle being arranged ahead of a compression zone of the portion turret (354) where said portions (21) are compressed, in a direction of conveyance of said portions (21).

* * * * *